United States Patent [19]

Dieringer et al.

[11] Patent Number: 4,538,793

[45] Date of Patent: Sep. 3, 1985

[54] DUAL CLAW SPIKE PULLER

[75] Inventors: Andrew M. Dieringer, Waterford; Ervin M. Sheperd, Milwaukee, both of Wis.

[73] Assignee: Rexnord Inc., Brookfield, Wis.

[21] Appl. No.: 615,010

[22] Filed: May 29, 1984

[51] Int. Cl.[3] ..... B25C 11/00; B66F 15/00

[52] U.S. Cl. ..... 254/18

[58] Field of Search ..... 254/18, 21–24, 254/30, 132; 294/88, 106

[56] References Cited

U.S. PATENT DOCUMENTS

| | | | |
|---|---|---|---|
| 1,771,712 | 7/1930 | Jimerson | 254/18 |
| 3,066,913 | 12/1962 | Leeson | 254/18 |
| 3,883,118 | 5/1975 | Miller . | |

OTHER PUBLICATIONS

"Nordberg Spike Puller" (Advertisement), Rexnord, Railway Equipment Division, 1973.

"We Didn't Pull Punches When We Designed Our Spike Pullers" (Advertisement), Modern Railroads, Mar. 1984, pp. 20–21.

"Dual Spike Puller W 113-B", Fairmont Railway Motors.

*Primary Examiner*—Robert C. Watson

*Attorney, Agent, or Firm*—William L. Falk

[57] ABSTRACT

A machine for pulling spikes from railroad ties including a pair of claws supported by the machine frame, one of the claws being positioned on one side of the rail and for pulling spikes on that side of the rail and the other of the claws being positioned on an opposite side of the rail and for pulling spikes on that side of the rail. Each of the claws including a lower end portion having a pair of spaced fingers extending toward the rail, and each claw being supported for movement from a retracted position to a position wherein the fingers of that claw are positionable under the head of a spike on opposite sides of the spike. The claws then move upwardly to pull spikes from the ties.

14 Claims, 10 Drawing Figures

DUAL CLAW SPIKE PULLER

FIELD OF THE INVENTION

The present invention relates to machines for use in maintenance of railroad track and more particularly to apparatus for use in removing spikes from railroad ties.

BACKGROUND PRIOR ART

Maintenance of railroad track and replacement of railroad ties requires the removal of spikes from the ties to permit separation of the track from the ties and positioning of new ties. Removal of the spikes is also required to permit replacement of worn or damaged rails or replacement of joined rails with continuous lengths of rail welded together.

One of the prior art methods for use in removing the spikes from the ties and tie plates requires the use of a pry bar having a claw on one end, and the spikes are manually pried out of the ties.

Machines have also been constructed for mechanically pulling spikes out of the ties. Such machines commonly include a clamping assembly including a pair of jaws movable toward and away from each other and operable to grip the head of the tie spike. Mechanical means are provided for then lifting the clamping assembly such that the spike is pulled from the tie and tie plate. This means for lifting the clamping assembly can be either a hydraulic cylinder or a mechanical lifting device.

One of the problems with such prior art spike pulling machines is that in many cases two operators are required, one to operate and guide the clamping devices on one side of the rail and another operator to guide the clamping assembly on the other side of the rail. Another problem with the prior art spike pullers is that they are not effective to pull spikes where there is a joint of two rails. The mechanical structure of the joint interfers with the opposed clamping members and prohibits the opposed clamping jaws from gripping the spike head. Commonly, the spikes in the area of each joint must be removed manually using a pry bar.

Another problem with prior art spike puller machines is that the entire machine must be carefully positioned over each spike so that the clamping members are properly aligned on opposite sides of the spikes.

Another problem with the prior art spike pullers is that maintenance of the machines can be expensive. The clamping members or jaws may become worn and replacement is expensive.

SUMMARY OF THE INVENTION

The present invention provides an improved spike puller machine which overcomes these problems of the prior art constructions. The spike puller embodying the invention can be operated by a single operator who can ride along the machine, and the operator can simultaneously pull spikes from both sides of the rail. The machine of the invention also provides a spike engaging structure which is effective to pull spikes from the ties even in the areas of the rail joints. The spike puller embodying the invention is also easily and quickly aligned with the spikes even if the spikes are not positioned at uniform intervals along the track. The alignment or "spotting" features of the machine embodying the invention yield faster operation of the machine by a single operator and improved efficiency.

Another feature of the present invention is that the claws of the spike puller are more resistant to wear than the prior art clamping jaws and are also less expensive to replace and more quickly replaced when they do become worn. Each claw is normally less expensive to replace than just one set of the jaws of the conventional gripping or clamping assembly.

More specifically, the invention includes a machine for use in pulling spikes from railroad ties and including a machine frame having wheels for supporting the machine frame for movement along railroad tracks, an engine supported by the machine frame for driving at least one of the axles, and a pair of claws supported by the frame, one of the claws being positioned on one side of the rail and for pulling spikes from that side of the rail and the other of the claws being positioned on an opposite side of the rail and for pulling spikes on that side of the rail. Each of the claws includes a lower end portion having a pair of spaced fingers extending toward the rail, the fingers being positionable under the head of the spike and on opposite sides of the spike.

One of the features of the invention is the provision of means for supporting the claws for movement downwardly and inwardly toward the rail into a position wherein each claw engages a spike and then moves upwardly to pull the spike from the tie.

In a preferred form of the invention the means for supporting the claws includes a vertically extending hydraulic cylinder supported by the frame, the hydraulic cylinder including a vertically reciprocal piston connected to the claws and operable to cause selective vertical reciprocal movement of the claws. Means are also provided for causing reciprocal movement of the claws between an open position wherein the claws are spaced apart and positioned away from opposite sides of the rail and a closed position wherein the claws are moved to a position adjacent the rail wherein the claws engage the spikes.

In a preferred form of the invention the means for causing reciprocal movement of the claws includes a second fluid cylinder, the second fluid cylinder extending generally horizontally and including opposite ends, one of the ends of the second fluid cylinder being connected to one of the claws, and the opposite end of the second fluid cylinder being connected to the other of the claws.

In a preferred form of the invention the machine further includes means for supporting the claws for adjustable horizontal movement in the direction of the longitudinal axis of the track with respect to the machine frame, this means including a second frame. Means are also provided for supporting the second frame for horizontal reciprocal movement with respect to the machine frame and in the direction of the longitudinal axis of the rail, and the claws are supported by the second frame.

In one embodiment of the invention means are provided for causing adjustable positioning movement of the claws with respect to the machine frame, this means including a lever having a lower end pivotally joined to the machine frame and the lower end of the lever also being connected to the second frame.

The invention also includes a spike pulling machine for use in pulling spikes out of railroad ties, and including a machine frame, wheels for supporting the machine frame for movement along the rails, an engine for driving the machine frame along the track, and at least one claw adapted to engage successive ones of the spikes and to pull the successive ones of the spikes out of the ties. The claw includes a lower end having a pair of spaced fingers fixedly joined together and adapted to be positioned on opposite sides of successive ones of the spikes and beneath the heads of the spikes.

Means are also provided for causing movement of the claw from a raised position wherein the claw is positioned above the spike and in spaced lateral relation to the spike to a lower engaged position wherein the fingers of the claw are positioned beneath the head of the spike, and a spike pulling position wherein the spike is pulled upwardly out of the tie.

In a preferred form of the invention the means for supporting the claws includes a second frame supported by the machine frame for horizontal reciprocal movement to provide for horizontal positioning of the claws with respect to the spike and a frame assembly supported by the second frame for vertical reciprocal movement with respect to the second frame and with respect to the machine frame. The spike pulling machine also includes a pair of pivotable arms, each of the arms having an upper end pivotally connected to the frame assembly and a lower end, the lower ends of the arms each supporting a claw for pulling spikes, one claw positioned on one side of the rail and the other claw positioned on the other side of the rail. A first fluid cylinder is supported by the second frame and connected to the frame assembly for causing vertical reciprocal movement of the frame assembly and the pivotable arms supporting the claws with respect to the machine frame and the spikes. A horizontal fluid cylinder is also provided and is positioned between the pivotable arms, the horizontal fluid cylinder including one end pivotally connected to one of the arms and an opposite end connected to the other of the arms.

The invention also includes a claw for use in a spike pulling machine and for use in pulling a railroad spike out of a railroad tie supporting a rail. The claw includes an upper end adapted to be supported by the spike pulling machine, the upper end comprising a metal plate defining a generally vertical plane parallel to the longitudinal axis of the rail, and a lower end integrally joined to the upper end and inclined downwardly from the upper end and toward the rail. The lower end terminates in a pair of rigidly connected spaced apart fingers adapted to be moveable from a position spaced horizontally from the spike to a position wherein the fingers are positioned beneath the head of the spike.

Various other features and advantages of the invention will be apparent by reference to the following description of a preferred embodiment, from the claims, and from the drawings.

Figure 1:
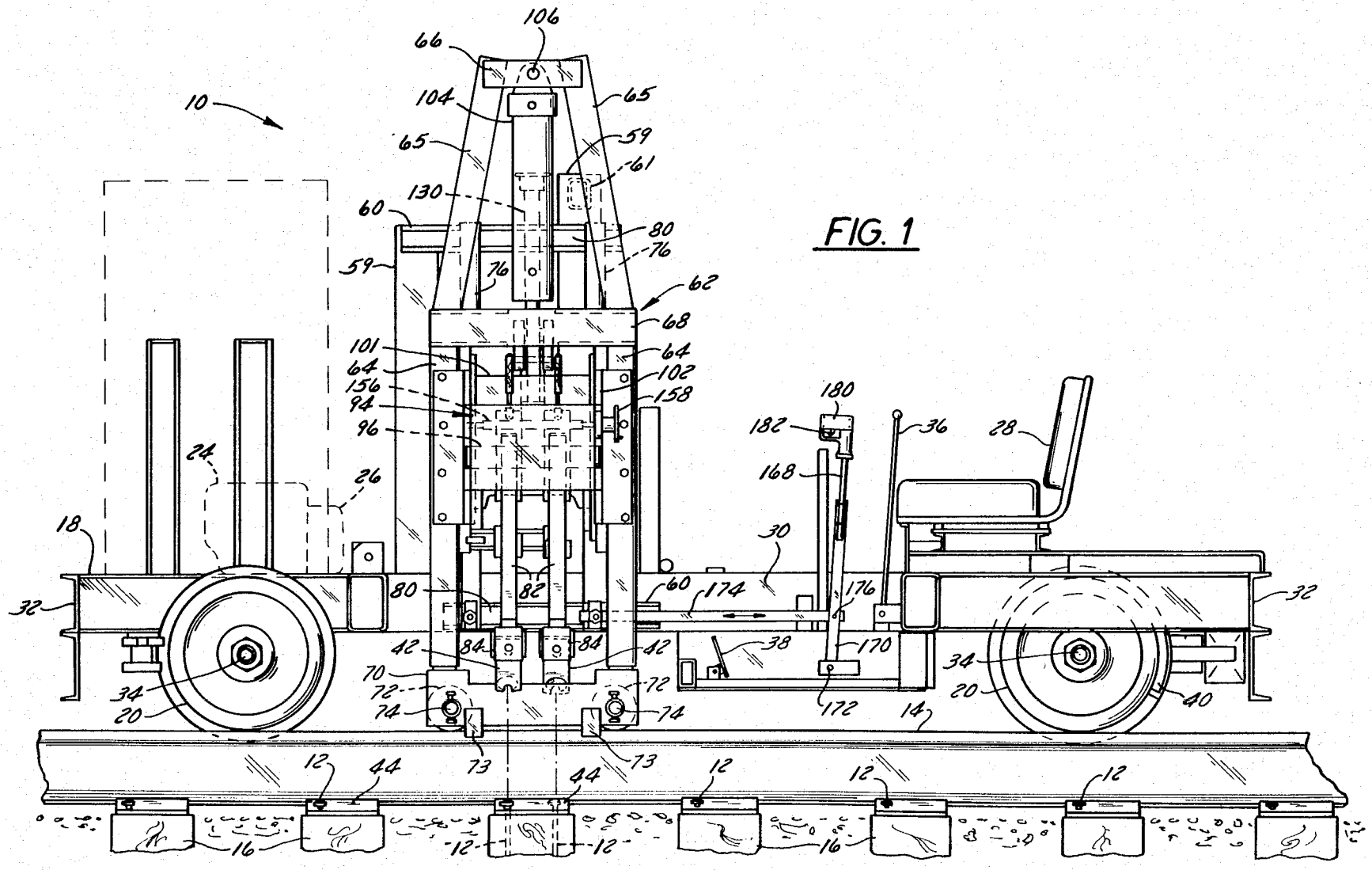
FIG. 1 is a side elevation view of a spike pulling machine embodying the present invention.

Before describing a preferred embodiment of the invention in detail, it is to be understood that the invention is not limited in its application to the detailed construction and to the arrangements set forth in the following description nor illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a machine 10 for use in pulling spikes 12 from railroad ties to provide for removal of rails 14 and replacement of worn rails 14 or worn ties 16. The machine 10 includes a frame 18 supported on the rails 14 by a plurality of wheels 20. The frame 18 supports a conventional internal combustion engine 24 and conventional means are provided for drivingly connecting the engine 24 to at least one of the wheels 20 for driving the machine 10 along the rails. The machine also includes a conventional hydraulic pump 26 driven by the engine 24 and providing hydraulic fluid pressure for operating hydraulically driven apparatus of the machine 10. The machine also includes an operator's seat 28 supported by a rearward portion of the frame 18 and for use by a single operator.

Referring more particularly to the specific configuration illustrated in FIG. 1, the frame 18 is rectangular and includes a pair of beams 30 joined at their opposite ends by cross-beams 32. The beams 30 are supported by axles 34, and the wheels 20 are rotatably mounted on the opposite ends of the axles 34. The wheels 20 ride on the rails 14 and support the machine for movement along the railroad track.

During operation of the machine 10, the operator controls movement of the machine along the track with a propulsion valve control 36 and a brake pedal 38. The propulsion valve control 36 is connected to the engine 24 in a conventional manner such that forward movement of the upper end of the propulsion valve control 36 will cause the machine to be driven forwardly. The brake pedal 38 is connected to a brake shoe 40 and is operable to control braking of the machine 10.

The spike pulling machine 10 also includes a pair of spike pulling claws 42, one positioned on one side of the rail 14 and the other positioned on an opposite side of the rail (FIG. 2), the spike pulling claws 42 being supported such that they can simultaneously engage spikes 12 on opposite sides of the rail 14 and pull these spikes 12 out of the tie plates 44 and ties 16. Generally, the claws 42 each comprise a forged metal plate having a lower portion 46 (FIG. 6) including a pair of fingers 48 projecting downwardly and toward the rail 14. The fingers 48 are positioned in spaced apart relation such that they can be positioned on opposite sides of the shaft 50 of a spike 12 and beneath the head 52 of the spike. The lower portion 46 of each claw 42 also defines an aperture 54 between the fingers 48 for housing the shaft 50 of the spike when the fingers 48 are positioned under the head 52 of the spike. In the illustrated construction the aperture 54 is tapered such that it has a substantially smaller diameter at the rearward surface of the claw than at the surface facing the spike to be pulled. This construction facilitates movement of the claw 42 into engagement with a spike such that the head of the spike is securely housed in the aperture in the lower end of the claw.

Means are also provided for supporting the claws 42 for movement from a retracted position to a position wherein the lower ends 46 of the claws 42 can engage spikes 12 on opposite sides of a rail 14 and then to a position wherein the claws 42 pull the spikes 12 upwardly out of the tie and tie plate. A generally vertically extending frame structure 58 fixedly supported by the machine frame 18 extends upwardly from a central portion of the machine frame. In the illustrated arrangement the vertically extending frame structure is defined by a plurality of upwardly extending beams 59, two of the beams 59 being joined at their upper ends by a cross member 61. The upwardly extending beams 59 also fixedly support a pair of horizontally extending tracks or channels 60. The tracks 60 are vertically spaced apart with respect to one another.

The machine 10 also includes a horizontally reciprocal second frame 62. While the second frame 62 could be constructed in various ways, in the illustrated arrangement, the second frame 62 has a generally "A" frame configuration and includes a pair of vertically extending frame members 64. The upper ends 65 of the vertically extending frame members 64 converge and are joined at their upper ends by connecting bars 66. The vertically extending frame members 64 are joined intermediate their opposite ends by a cross member 68 and are rigidly joined together at their lower ends by a base member 70. The second frame 62 is supported such that the base member 70 is positioned immediately above the rail 14 and parallel to the longitudinal axis of the rail 14. The second frame 62 extends upwardly from the rail 14 and defines a vertical plane including the longitudinal axis of the rail 14.

Means are also provided for supporting the second frame 62 for movement along the rail 14. In the illustrated construction the base member 70 comprises a hollow box beam open at its opposite ends. The opposite ends each house a roller or wheel 72 supported by shafts 74 and adapted to rest on the upper surface of the rail 14 and roll along the rail to support the second frame 62. Guides 73 extend downwardly from opposite sides of the base member 70 and are positioned on opposite sides of the rail 14 to maintain alignment of the second frame 62 on the rail.

Figure 2:
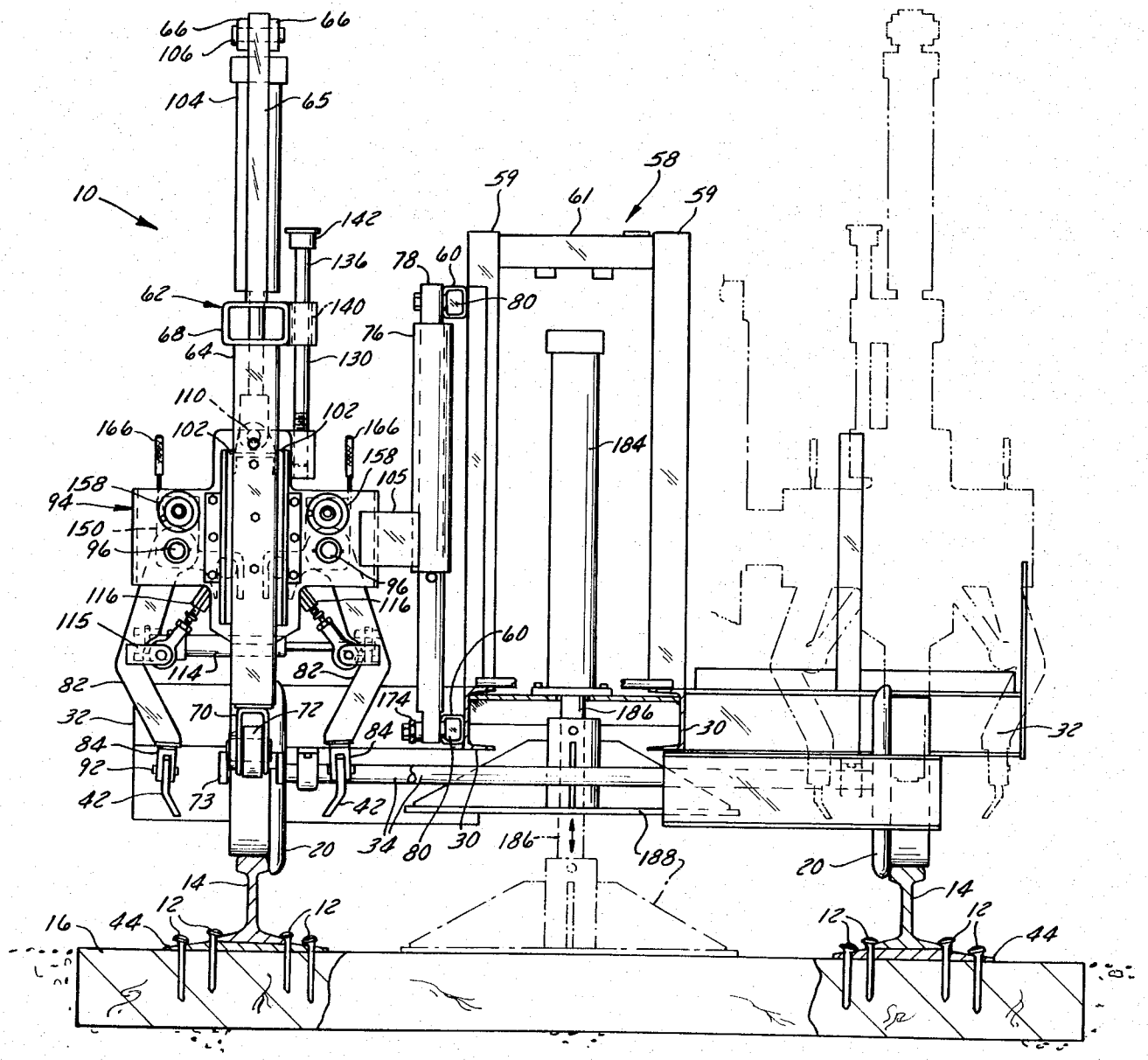
FIG. 2 is a cross section elevation view of the spike pulling machine illustrated in FIG. 1.

Means are also provided for supporting the claws 42 such that the claws 42 are freely reciprocably movable with respect to the machine frame 18 horizontally forwardly and rearwardly in the direction of the rails 14. The means for providing such horizontal reciprocal movement permits adjustment of the position of the claws 42 with respect to the spikes 12 without requiring movement of the entire machine 10 into accurate alignment with the spikes 12. The means for supporting the claws 42 for adjustable movement includes a pair of spaced vertically extending tubes or sleeves 76 (FIG. 2). Also included are a pair of spaced vertically extending shafts 78. The upper ends of the shafts 78 are supported by a slide block 80 supported for slideable movement in the upper track 60, and the lower ends of the shafts 78 are similarly supported by a slide block 80 housed in the lower horizontally extending track or channel 60 supported by the machine frame 18. The vertically extending shafts 78 are supported for limited reciprocal horizontal movement by the slide blocks 80 to provide for adjustable positioning of the claws 42 with respect to the spikes 12.

Figures 3, 6:
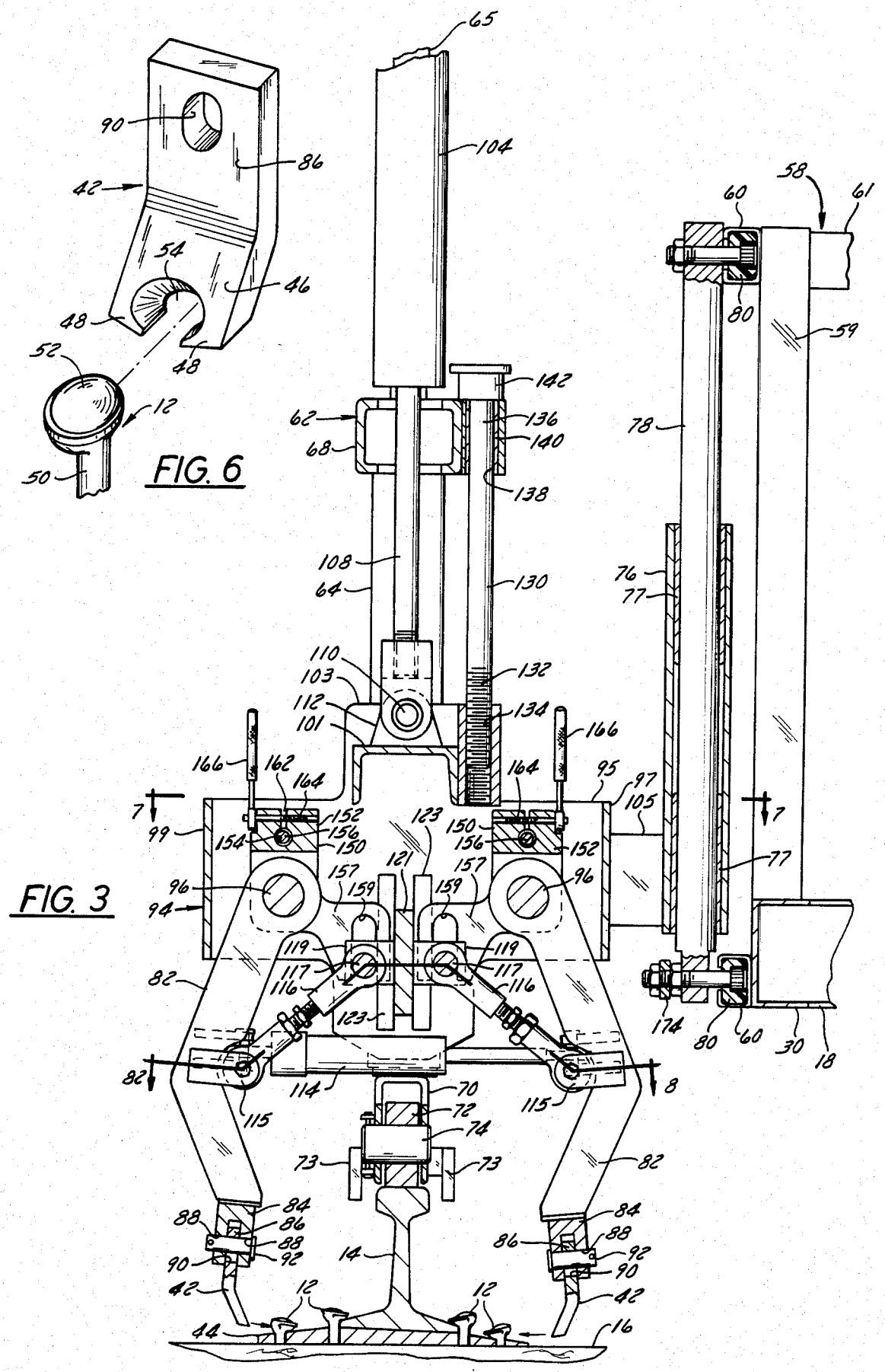
FIG. 3 is an enlarged partial view of structure illustrated in FIG. 2 and with portions broken away and also showing the spike pulling claws in a lowered position.
FIG. 6 is an enlarged perspective view of a spike pulling claw illustrated in FIGS. 1–5.

The sleeves 76 surround the vertically extending shafts 78 and are supported thereon by bearings 77 for vertical reciprocal movement between a raised position as shown in FIG. 2 and a lowered position shown in FIG. 3.

The means for supporting the claws 42 also includes a pair of pivotable support arms 82. The lower ends of the support arms 82 support the claws 42. The lower end of each support arm 82 defines a clevis 84 adapted to house the planar upper portion 86 of the claws 42. The lower ends of the support arms 82 include bores 88, and the upper portion of each of the claws 42 includes a slot 90. A pin 92 is adapted to extend through the bore 88 and slot 90 to secure the claw 42 to the support arm 82.

In a preferred form of the invention the clevis 84 will support the claw 42 such that it is freely pivotable or movable about the axis of the pin 92 and the slot 90 will permit limited vertical shiftable movement of the claw 42 with respect to the clevis 84. Accordingly, the claw 42 is relatively loosely supported such that the claw can align itself with the spikes 12 as it is moved into engagement with a spike.

Figure 9:
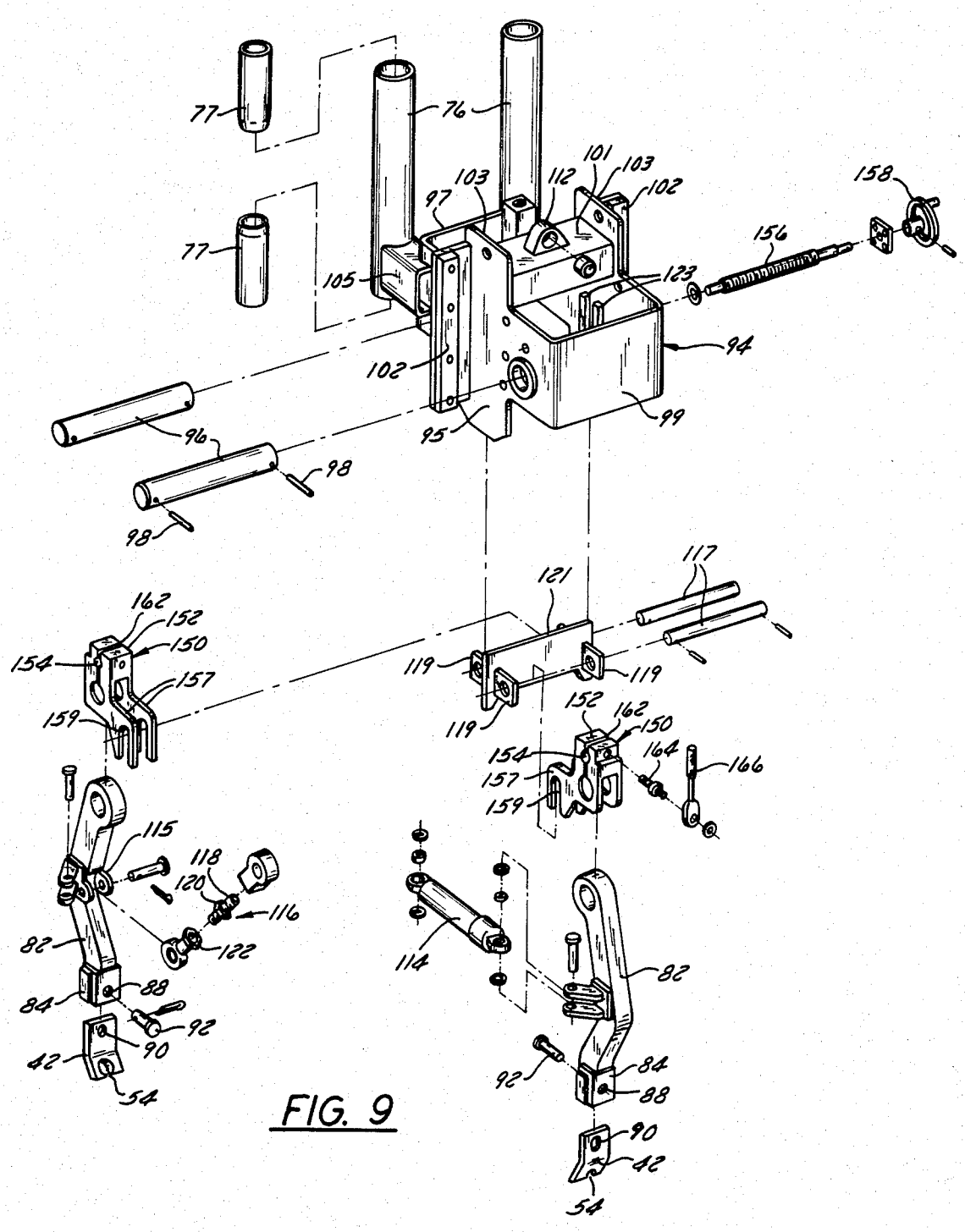
FIG. 9 is an exploded perspective view of apparatus illustrated in FIGS. 1–5 and for supporting the spike pulling claws.
Figure 10:
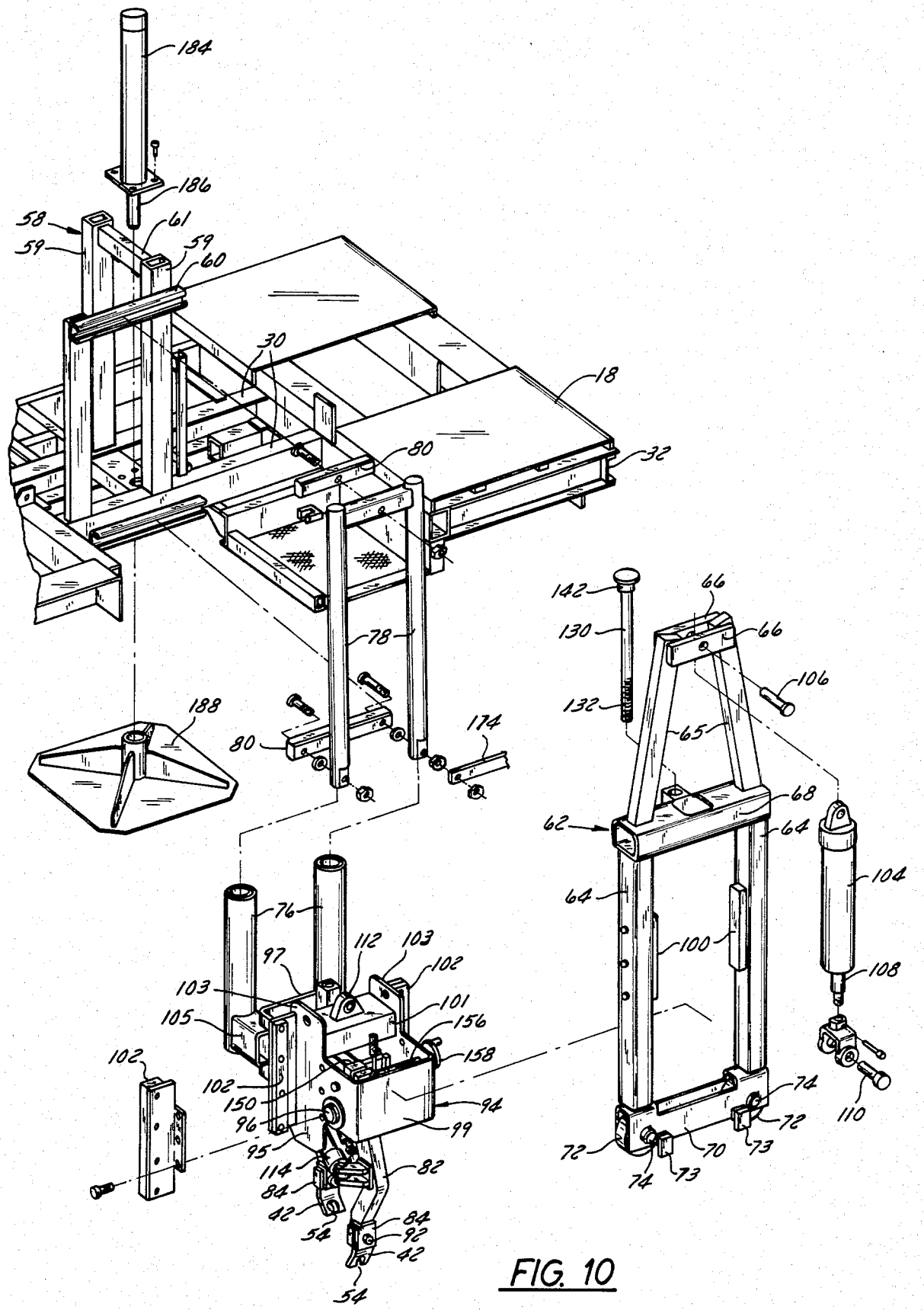
FIG. 10 is an exploded perspective view of a portion of the spike pulling machine illustrated in FIG. 1.

The upper ends of the support arms 82 are pivotally joined to a support block 94 best shown in FIGS. 9–10. The support block 94 comprises a generally hollow box-like structure which is open at the top and bottom. The support block 94 includes a pair of spaced vertical side walls 95 and a pair of vertical end walls 97 and 99 joining the side walls 95. The sidewalls 95 are slso joined by a connecting beam 101 extending between and rigidly joining upwardly extending portions 103 of the side walls 95. The support block 94 is rigidly joined to the tubes 76 by a pair of connecting members 105 welded to the tubes 76 and welded to the end wall 97. The support block 94 is thus supported for vertical reciprocal movement and horizontal adjusting movement with the tubes or sleeves 76.

The arms 82 are pivotally joined to the support block 94 by pivot rods or shafts 96 extending through the upper end of the support block 94 and with opposite ends of the pivot shafts 96 journalled in bores in the side walls 95 of the support block 94. The pivot shafts 96 are held in place with respect to the support block 94 by pins 98 (FIG. 9) extending through opposite ends of the shaft 96. The support arms 82 are supported by the shafts 96 for pivotable movement about spaced parallel axes, these axes being horizontal and parallel to the longitudinal axis of the rail. The pivot arms 82 are also supported such that the claws 42 supported by the pivot arms 82 move toward and away from each other and toward and away from the rail 14.

Means are also provided for supporting the support block 94 for vertical reciprocal movement between the vertically extending frame members 64 of the second frame 62. While various means could be provided for maintaining this alignment, in the illustrated arrangement the second frame 62 includes a pair of integral vertically extending linear guides 100 supported by the opposed surfaces of the vertical frame members 64 and adapted to be slideably housed between pairs of vertically extending tracks 102 of the support block 94.

Means are also provided for causing selective vertical reciprocal movement of the support block 94, the support arms 82, and the claws 42 with respect to the rails 14 and the second frame 62. In the illustrated construction, this means includes a hydraulic cylinder 104 having one end pivotally joined by a pin 106 to the connecting bars 66 of the second frame 62. The cylinder rod 108 extends downwardly from the lower end of the cylinder 104 and has a lower end pivotally connected by a pin 110 to a flange 112 extending upwardly from the connecting beam 101 of the support block 94. The cylinder 104 is operable to cause vertical reciprocal movement of the support block 94 with respect to the second frame 62.

Means are also provided for causing pivotal movement of the pivotable support arms 82 such that the claws 42 are movable toward and away from each other and toward and away from the rail 14. The means for causing such movement of the pivotable arms 82 includes a second hydraulic cylinder 114 mounted between the pivotable arms 82 and in generally horizontal relation. One end of the second hydraulic cylinder 114 is pivotally connected to one of the pivotable arms 82, and the other of the opposite ends of the second hydraulic cylinder 114 is pivotally connected to the other of the pivotable arms 82. In the illustrated arrangement the opposite ends of the second hydraulic cylinder 114 are connected to the pivot arms intermediate the upper and lower ends of the pivotable arms 82.

Figure 4:
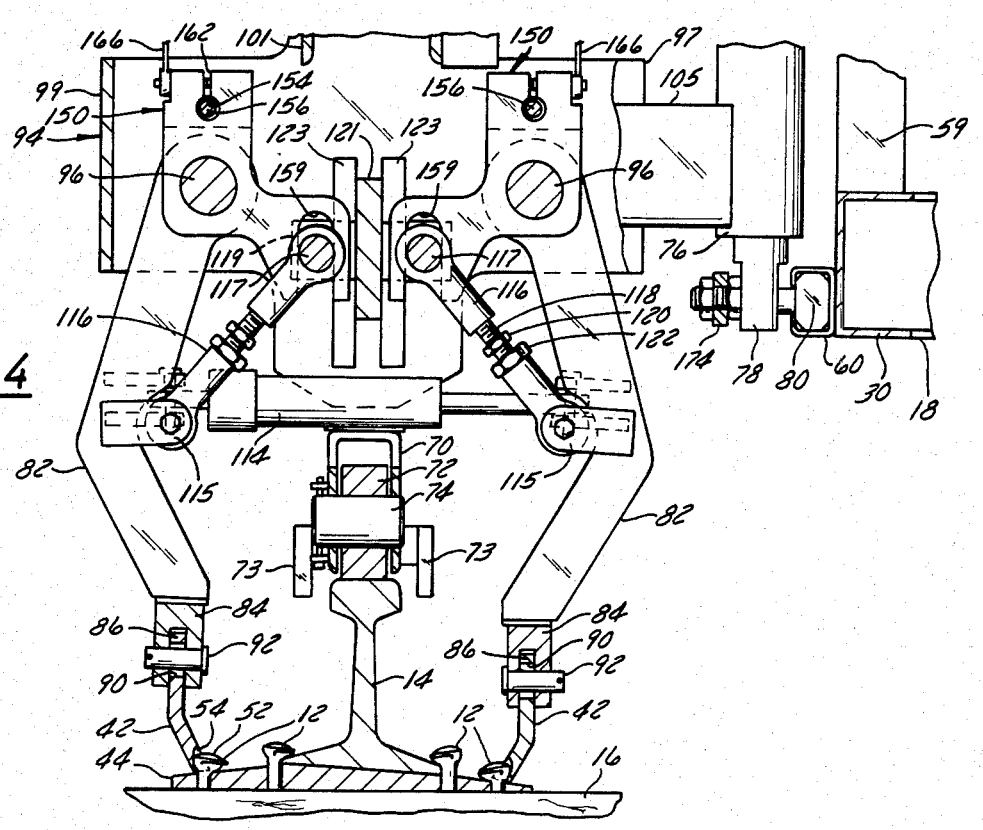
FIG. 4 is a partial view similar to FIG. 3 and showing the spike pulling claws in a spike engaging position.
Figure 5:
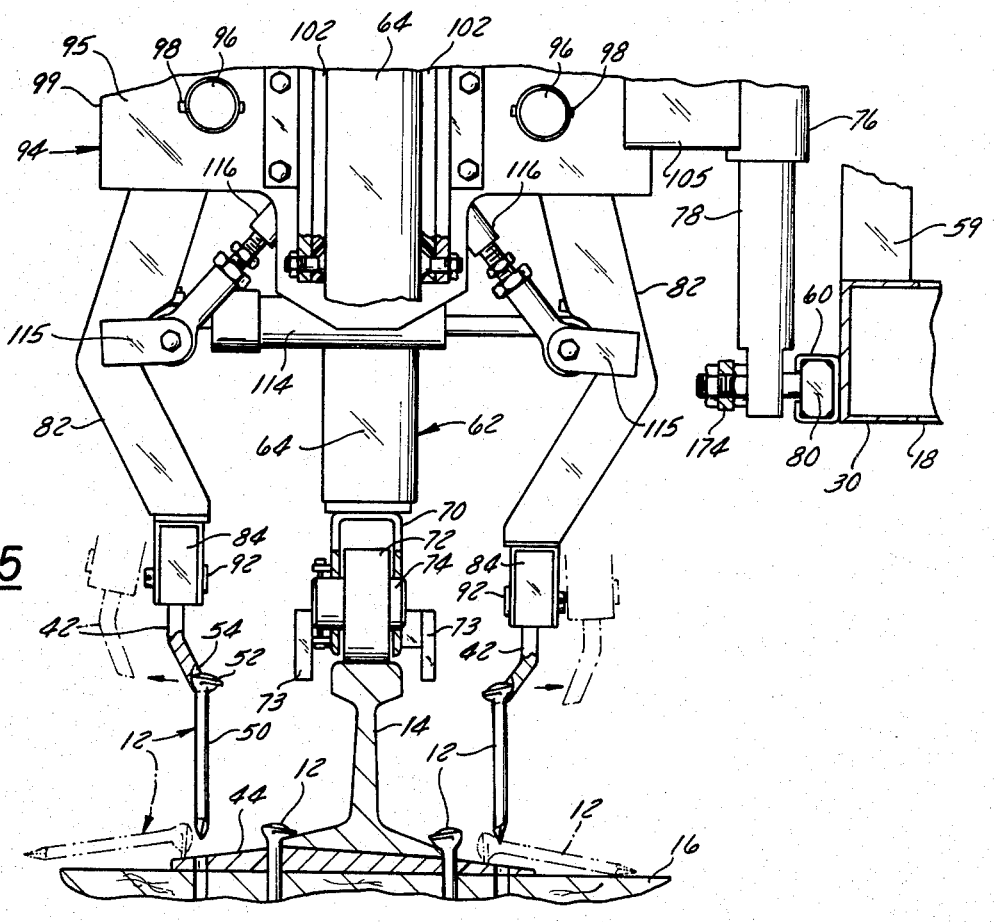
FIG. 5 is a view similar to FIG. 4 and showing the claws pulling spikes from the tie.

In operation of the claws 42 and the spike pulling apparatus embodying the invention and wherein the claws 42 are initially in the position illustrated in FIG. 2, the claws are moved into engagement with the spikes 12 by first actuating the first hydraulic cylinder 104 to cause downward movement of the support block 94 and the claws 42 to the position shown in FIG. 3. In this position the lower ends of the claws 42 are in generally horizontal alignment with the heads 52 of the spikes 12 and are spaced outwardly from the heads 52 of the spikes. The second hydraulic cylinder 114 is then actuated to cause movement of the claws 42 toward the rail 14 and until the fingers 48 of the claws 42 are positioned on opposite sides of the respective shafts 50 of the spikes 12 and beneath the heads 52 of the spikes. In this position, the heads 52 of the spikes are housed in the apertures 54 provided in the ends of the claws 42. The hydraulic cylinder 104 is then actuated to cause upward movement of the support block 94 and the claws 42 from the position shown in FIG. 4 to the position shown in FIG. 5 wherein the spikes 12 are pulled out of the ties 16 and the tie plates 44. In a preferred form of the invention means are also provided for supplying a pulse of hydraulic fluid to the second hydraulic cylinder 114 to cause rapid movement of the pivotable support arms 82 and the claws 42 from the position shown in solid lines in FIG. 5 to the position shown in phantom. Such rapid movement of the claws 42 causes the claws to move away from the spikes 12 and the spikes will drop onto the ground as shown in phantom in FIG. 5 The claws 42 are then in position to repeat the spike pulling operation.

One of the features of the invention is that the spikes 12 are pulled vertically upwardly out of the ties 16 and are not bent as they are removed.

Another feature of the invention is that the apparatus for pulling the spikes out of the ties is supported by the rail 14 during the spike pulling operation. More specifically, the first hydraulic cylinder 104 which applies upward force on the claws 42, is supported by the second frame 62. The second frame 62 is positioned immediately above the rail 14 and is supported by the rollers 72. Accordingly the pulling force is not transmitted to the machine frame 18, and the machine frame 18 need not be constructed to withstand lateral bending loads.

In a preferred form of the invention, means are also provided for adjusting the lower vertical position of the claws 42, i.e., the position of the claws 42 when the hydraulic cylinder 104 is extended and the claws 42 are in the position shown in FIG. 3. While various means could be provided for adjusting the vertical position of the claws, in the illustrated arrangement this means includes a vertically extending shaft 130 having a threaded lower end 132 housed in a threaded bore 134 in the support block 94. The upper end 136 of the vertically extending shaft 130 is rotatably housed in a bore 138 of a bushing 140 fixed to the horizontal frame member 68 of the second frame 62. The upper end 136 of the shaft 130 also supports a collar 142 adapted to engage an upper surface of the bushing 140 when the claws 42 are in their lower position and to thereby limit the length of the stroke of the hydraulic cylinder 104 and restrict the downward movement of the claws 42.

Figure 7:
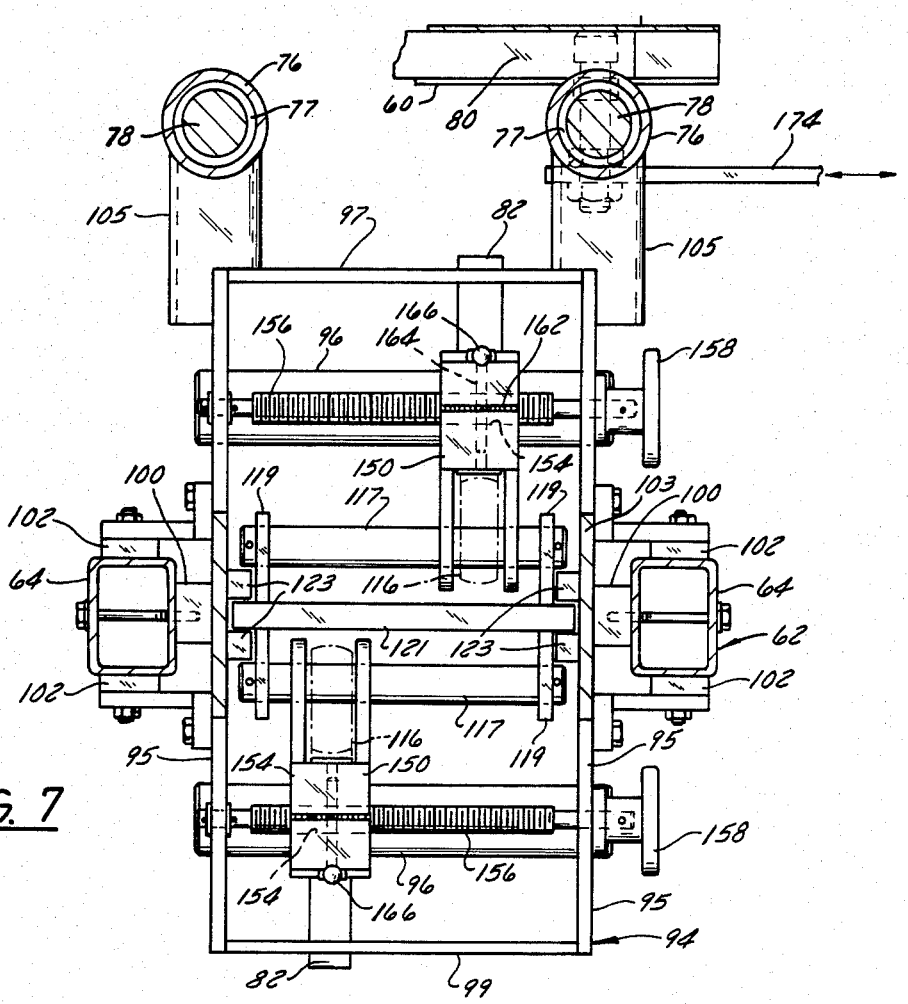
FIG. 7 is a cross-section view taken along lines 7—7 in FIG. 3.

Means are also provided for adjusting the position of the claws 42 with respect to each other in the direction of movement of the machine 10 to thereby accommodate different types of tie plates 44 having different patterns of holes for housing the spikes 12. This means for adjusting the spacing between the claws 42 is best illustrated in FIGS. 3 and 7 and includes a pair of guides 150 supported on the support shafts 96 for slideable movement in the direction of the longitudinal axes of the support shafts and housing the upper ends of the pivotable support arms 82. The guides 150 are adjustably movable along the support shafts 96 to provide for adjustable positioning of the upper ends of the pivotable support arms 82. While the guides 150 could have other constructions, in the illustrated arrangement, each of the guides 150 includes an upwardly extending portion 152 having a threaded bore 154 housing an elongated threaded shaft 156. The elongated threaded shaft 156 is rotatably supported at its opposite ends by the side walls 95 of the support block 94 and includes a longitudinal axis parallel to the pivot axis of the support arm 82. A hand wheel 158 is fixed to one end of the threaded shaft 156. The machine operator can rotate the hand wheel 158 to cause rotation of the threaded shaft 156 and consequent adjustable movement of the guide 150 threaded on that threaded shaft 156 and thereby cause movement of the guide 150 and the pivotable support arm 82 on the shaft 96 in the direction of the axis of the rail 14.

Means are also provided for selectively locking the guide 150 in position on the threaded shaft 156. In the illustrated arrangement the upper end of the guide 150 includes a slot 162 (FIG. 3) and can clampingly engage the threaded shaft 156. A bolt 164 extends through the upper portion 152 of the guide 150 and provides means for clamping the upper portion of the guide against the threaded shaft 156. In the illustrated arrangement a rachet 166 is mounted on each of the bolts 164 for use in tightening and loosening the locking bolts 164.

Figure 8:
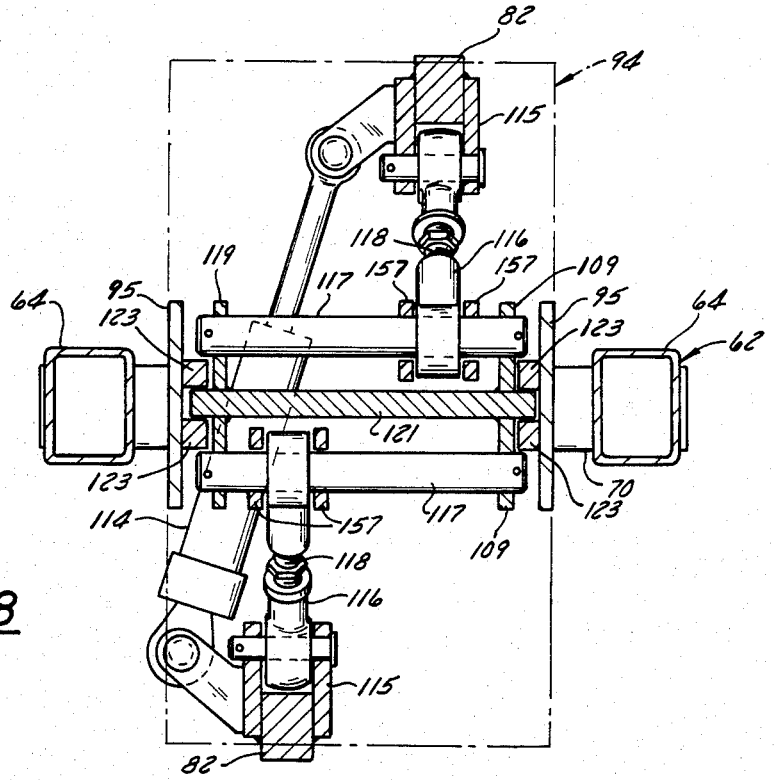
FIG. 8 is a cross-section view taken along line 8—8 in FIG. 3.

Means are also provided for supporting the pivotable arms 82 for movement in directions perpendicular to the longitudinal axis of the rail 14 and for preventing twisting of the pivotable arms. In the illustrated construction this means includes a pair of connecting links 116. The connecting links 116 each have one end pivotally connected by brackets 118 to the pivotable arms 82 intermediate the opposite ends of the pivotable arms 82, and the upper ends of the connecting links 116 are supported by a pair of spaced apart parallel guide shafts 117. The opposite ends of the guide shafts 117 are supported by a pair of plates 119, and the plates 119 are in turn supported for vertical reciprocal movement by a plate 121. The opposite ends of the plate 121 are slideably housed in tracks 123 supported by the side walls 95 of the support block 94. As illustrated in FIG. 8, the claw 42 and the claw support arm 82 on one side of the rail 14 is positioned forwardly of the other claw 42 and claw support arm 82 with respect to the direction of movement of the machine 10. The claws are positioned in this manner because the spikes 12 in the tie plate 44 are offset with respect to one another. Since the pivotable support arms 82 are offset with respect to one another, the second hydraulic cylinder 114 is not perpendicular to the pivot axes of the pivotable support arms 82. During operation of the second hydraulic cylinder 114, it tends to apply force on the pivotable support arms 82 tending to cause them to bind on the pivot pins or pivot shafts 96 supporting the support arms 82. The links 116 are provided to support the pivotable support arms 82 against forces on the pivotable arms 82 in the direction of the longitudinal axis of the rail.

The upper ends of the connecting links 116 are also supported by the guides 150 such that the connecting links 116 slide along the shafts 117 when the pivot arms 82 slide along the shafts 96. Each guide 150 includes a lower end defining a pair of downwardly extending flanges 157, the flanges being positioned on opposite sides of the upper end of a connecting link 116. The flanges 157 include verticlly extending slots 159 housing the shafts 117 and permitting vertical slideable movement of the shafts 117 with respect to the guides 150.

The connecting links 116 also include means for adjusting the length of the links 116. This adjustment means is provided by a threaded shaft 118 forming a central portion of the connecting link 116. A nut 120 is fixed to a mid-portion of the threaded shaft 118 and permits rotation of the threaded shaft 118 to provide for adjustment of the length of the connecting link 116. A lock nut 122 is also threaded onto the central shaft.

Means are also provided for causing adjustable horizontal movement of the second frame 62 with respect to the machine frame 18 to thereby provide for alignment of the claws 42 with the rails 14. In the illustrated construction this means includes a manually operable lever 168 (FIG. 1) having a lower end 170 pivotally joined to the machine frame 18 by a pin 172 such that the operator can move the upper end of the lever 168 forwardly and rearwardly. A push rod 174 is connected at its forward end to one of the vertical shafts 78 and is pivotally connected by a pin 176 at its rearward end to the lever 168 near its lower end but in spaced relation from the pivotal connection such that forward movement of the upper end of the lever 168 causes forward movement of the second frame 62 and the claws 42 with respect to the machine frame 18, and rearward movement of the upper end of the lever 168 causes rearward movement of the second frame 62 and the claws 42. The lever 168 is positioned such that its upper end can be conveniently gripped by the operator supported on the seat 28.

In a preferred form of the invention, the upper end of the lever 168 also supports a trigger arrangement 180 for use in controlling actuation of the means for causing movement of the claws 42 into engagement with the spikes 12 and for causing the spikes to be pulled out of the ties 16. In one form of the invention the trigger arrangement 180 comprises a three position electrical switch. The electrical switch is a conventional electro-optical switch and is connected to conventional hydraulic control valves. When the trigger 182 is moved from its forward position to an intermediate position, a first hydraulic control valve will be actuated to cause retraction of the rod of the cylinder 114 thereby causing the claws 42 to slip under the heads, of the spikes. Subsequent movement of the trigger to its rearwardmost position causes contraction of the vertically extending hydraulic cylinder 104 and movement of the claws upwardly thereby pulling the spikes from the tie. When the operator then releases the trigger 182 permitting it to return to its original forward position, the horizontal hydraulic cylinder 114 forces the claws 42 outwardly to cause the spikes 12 to fall on the ground. Simultaneously the vertical cylinder 104 extends to move the claws again to their lower position for the next spike pulling operation.

In a preferred form of the invention an electrical pulse generator is also provided to send a pulse signal to the hydraulic control for the horizontally extending hydraulic cylinder 114 and causing a pulse of hydraulic fluid to be delivered to that cylinder to cause extension of the cylinder 114 and a quick outward movement of the support arms 82 to cause the spikes 12 to be dropped.

In operation of the spike pulling machine 10, it is to be driven along the track in one direction to remove spikes 12 securing one rail 14. The machine 10 is then turned around and driven in an opposite direction to remove spikes from the other rail. To permit the machine to be turned around, a hydraulic cylinder 184 (FIGS. 2 and 10) is mounted vertically generally at the center of gravity of the machine 10. The hydraulic cylinder 184 includes a rod 186 having a lower end supporting a base or platform 188. When the rod 186 is extended, the platform 188 will move to the position shown in phantom in FIG. 2. Further extension of the piston 186 will cause the machine 10 to be lifted. The machine can then be manually rotated 180° about the vertical axis of the hydraulic cylinder 184. The hydraulic cylinder 184 can then lower the machine onto the rails. The claws 42 will then be positioned on opposite sides of the other rail 14 as shown in phantom in FIG. 2.

One of the principal advantages of the present invention is that the structure described above permits rapid spotting or alignment of the claws 42 with the spikes 12 in the railroad ties. Such quick alignment facilitates operation of the spike pulling machine.

The alignment features of the machine also permit relatively easy alignment by the operators since the operator does not have to control accurate movement of the entire machine in order to align the claws with the heads of the spikes and, accordingly, the machine of the invention is easier for the operator to control and requires less skill.

Another feature of the invention is that the machine can be easily constructed with the claws mounted either to the left or right side of the machine without requiring substantial design changes in the machine structure.

Another advantage of the construction of the invention is that the claws 42 can easily engage the spikes 12 even in the area of the rail joints thereby eliminating manual pulling of the spikes using a pry bar in the area of the joints.

Another feature of the invention is that the spike pulling machine causes the spikes to be pulled vertically upwardly out of the rail plate, and the spikes are not bent by the pulling process. Accordingly, the spikes can be re-used and straightening of the spikes is not required.

A further advantage of the apparatus described is that it can pull anchor and rail spikes without transverse adjustment of the claw supporting arms.

Another advantage of the invention is that the claws are relatively inexpensive to manufacture and are also replaced relatively easily and quickly. It will be readily appreciated that spike pulling tools are subjected to wear, and regardless of their construction and the quality of the materials, will require replacement from time to time. The claws embodying the invention can be manufactured at a price substantially less than the cost of the conventional mechanical spike gripping tools, and they are also easily removed from the ends of the pivotable support arms and replaced with substitute claws.

Various features of the invention are set forth in the following claims.

We claim:

1. A machine for use in pulling spikes from railroad ties wherein spikes are driven into railroad ties on opposite sides of a rail, and the spikes each include a head, the machine comprising a machine frame, wheels for supporting the machine frame for movement along railroad tracks, an engine supported by the machine frame for driving at least one of the wheels, a pair of claws supported by the machine frame, one of the claws being positioned on one side of the rail and for pulling spikes on that side of the rail and the other of the claws being positioned on an opposite side of the rail and for pulling spikes on that side of the rail, each of the claws including a lower end portion having a pair of spaced fingers extending inwardly toward the rail, each claw being supported for movement from a retracted position to a position wherein the fingers of that claw are positionable under the head of a spike on opposite sides of the spike, and further including means for supporting the claws for movement from the retracted position downwardly and inwardly toward the rail into a position wherein the claws engage spikes and then move upwardly to pull the spikes from the tie.

2. A machine as set forth in claim 1 wherein the means for supporting the claws includes a vertically extending fluid cylinder supported by the machine frame, the fluid cylinder including a vertically reciprocal piston connected to the claws and operable to cause selective vertical reciprocal movement of the claws, and means for causing reciprocal movement of the claws between a retracted position wherein the claws are spaced apart and positioned away from opposite sides of the rail and a closed position wherein the claws are moved to a position adjacent the rail wherein the claws engage the spikes.

3. A machine as set forth in claim 2 and further including means for supporting the claws for movement downwardly and inwardly toward the rail into a position wherein the claws engage spikes and then upwardly to pull the spikes from the ties.

4. A machine as set forth in claim 2 wherein the means for causing reciprocal movement of the claws between the retracted position and the closed position includes a second fluid cylinder, the second fluid cylinder extending generally horizontally and including opposite ends, one of the ends of the second fluid cylinder being connected to one of the claws, and the opposite end of the second fluid cylinder being connected to the other of the claws.

5. A machine as set forth in claim 4 and further including means for supporting the claws for adjustable horizontal movement in the direction of the longitudinal axis of the rail with respect to the machine frame, the means for supporting including a second frame, means for supporting the second frame for horizontal reciprocal movement with respect to the machine frame and in the direction of the longitudinal axis of the rail, the claws being supported by the second frame.

6. A machine as set forth in claim 5 wherein the first fluid cylinder and the second fluid cylinder are supported by the second frame.

7. A machine as set forth in claim 1 and further including means for supporting the claws for adjustable horizontal movement in the direction of the longitudinal axis of the rail with respect to the machine frame, the means for supporting including a second frame, means for supporting the second frame for horizontal reciprocal movement with respect to the machine frame and in the direction of the longitudinal axis of the rail, the claws being supported by the second frame.

8. A machine as set forth in claim 7 and further including means for causing adjustable movement of the claws with respect to the machine frame, the means for causing adjustable movement including a lever having a lower end pivotally joined to the machine frame and the lower end of the lever being connected to the second frame.

9. A machine as set forth in claim 7 and further including means for adjusting the horizontal position of the claws with respect to the second frame and in the direction of movement of the machine along the track, and means for adjusting the vertical position of the claws with respect to the machine frame.

10. A spike pulling machine for use in pulling spikes out of railroad ties, the spikes including a head, the spike pulling machine comprising:

a machine frame, wheels for supporting the machine frame for movement along the rails, the wheels being adapted to be supported on the rails, an engine supported by the machine frame and drivingly connected to at least one of the wheels for driving the machine frame along the track, at least one claw adapted to engage successive ones of the spikes and to pull the successive ones of the spikes out of the ties, the claw including a lower end having a pair of spaced fingers fixedly joined together and adapted to be positioned on opposite sides of successive ones of the spikes and beneath the heads of the spikes, and means for causing movement of the claw from a raised position wherein the claw is positioned above the spike and in spaced lateral relation to the spike to an engaged position wherein the fingers of the claw are positioned beneath the head of the spike, and a spike pulling position wherein the spike is pulled upwardly out of the tie, and means for causing outward movement of the claws away from the rail after the spike is pulled upwardly from the tie.

11. A spike pulling machine as set forth in claim 10 wherein the means for causing movement of the claw includes means for causing movement of the claw from the raised position to a lowered position wherein the lower end of the claw is positioned in horizontally spaced relation from the head of the spike to be pulled and away from the rail, and means for subsequently causing movement of the claw from the lowered position to the spike engaging position.

12. A spike pulling machine as set forth in claim 10 wherein the means for supporting the claw includes a frame assembly supported for vertical reciprocal movement, a pivotable arm, having an upper end pivotally connected to the frame assembly and a lower end, the lower end of the arm supporting the claw, a first fluid cylinder supported by the machine frame and connected to the frame assembly for causing vertical reciprocal movement of the frame assembly and the pivotable arm supporting the claw with respect to the machine frame, a horizontally extending fluid cylinder including one end pivotally connected to the pivotable arm.

13. A claw for use in a spike pulling machine and for use in pulling a railroad spike out of a railroad tie supporting a rail, the claw comprising:

an upper end adapted to be supported by the spike pulling machine, the upper end comprising a metal plate defining a generally vertical plane parallel to the longitudinal axis of the rail, a lower end integrally joined to the upper end and inclined downwardly from the upper end and toward the rail, the lower end terminating in a pair of rigidly joined spaced apart fingers adapted to be moveable from a position spaced horizontally from the spike to a position wherein the fingers are positioned beneath the head of the spike, wherein the lower end of the claw includes a generally circular opening between the spaced fingers, and wherein the lower end includes a first surface portion facing the rail and a rearward surface portion facing away from the rail and wherein the circular opening tapers such that it has a larger diameter adjacent the first surface portion than the diameter adjacent the rearward surface portion.

14. A claw as set forth in claim 13 wherein the first surface portion is generally planar and inclined downwardly and toward the rail.

* * * * *